US007658241B2

(12) United States Patent
Lassoie et al.

(10) Patent No.: US 7,658,241 B2
(45) Date of Patent: Feb. 9, 2010

(54) UNDERREAMING AND STABILIZING TOOL AND METHOD FOR ITS USE

(75) Inventors: Jean-Pierre Lassoie, Brussels (BE); Philippe Fanuel, Brussels (BE)

(73) Assignee: Security DBS NV/SA, Drogenbos (BE)

( * ) Notice: Subject to any disclaimer, the term of this patent is extended or adjusted under 35 U.S.C. 154(b) by 86 days.

(21) Appl. No.: 11/109,350

(22) Filed: Apr. 19, 2005

(65) Prior Publication Data

US 2005/0241856 A1 Nov. 3, 2005

Related U.S. Application Data

(63) Continuation-in-part of application No. PCT/BE2004/000057, filed on Apr. 21, 2004.

(51) Int. Cl.
*E21B 10/32* (2006.01)

(52) U.S. Cl. ..... 175/57; 175/269; 175/406; 175/286

(58) Field of Classification Search ..... 175/269, 175/406, 284, 267, 57, 279, 286
See application file for complete search history.

(56) References Cited

U.S. PATENT DOCUMENTS

| | | | | | |
|---|---|---|---|---|---|
| 336,187 | A | | 2/1886 | Wells | 175/290 |
| 1,411,484 | A | | 4/1922 | Fullilove | 175/267 |
| 1,454,843 | A | | 6/1923 | Brown | 175/264 |
| 1,485,642 | A | | 3/1924 | Stone | 175/268 |
| 1,607,662 | A | | 11/1926 | Boynton | 175/228 |
| 1,631,449 | A | | 6/1927 | Alford | 175/269 |
| 1,671,474 | A | | 5/1928 | Jones | 175/269 |
| 1,686,403 | A | | 10/1928 | Boynton | 175/228 |
| 1,750,629 | A | | 3/1930 | Crum | |
| 1,772,710 | A | | 8/1930 | Denney | 166/55.8 |
| 1,804,850 | A | | 5/1931 | Triplett | 175/271 |
| 1,878,260 | A | | 9/1932 | Bunker | 175/269 |
| 1,881,035 | A | * | 10/1932 | Triplett | 175/286 |
| 1,921,135 | A | * | 8/1933 | Santiago | 175/269 |
| 2,060,352 | A | | 11/1936 | Stokes | 175/268 |
| 2,169,502 | A | | 8/1939 | Santiago | 175/268 |
| 2,239,996 | A | | 4/1941 | Chappell | 175/261 |
| 2,271,472 | A | | 1/1942 | Balduf | 52/290 |
| 2,427,052 | A | | 9/1947 | Grant | 175/269 |
| 2,438,673 | A | | 3/1948 | McMahan | 175/267 |

(Continued)

FOREIGN PATENT DOCUMENTS

BE 1012545 A3 12/2000

(Continued)

OTHER PUBLICATIONS

Notification of International Search Report for International Application No. PCT/BE02/00031, filed May 7, 2002 (7 pages), May 16, 2002.

(Continued)

*Primary Examiner*—David J Bagnell
*Assistant Examiner*—David Andrews
(74) *Attorney, Agent, or Firm*—Baker Botts L.L.P.

(57) ABSTRACT

Provided is a drilling tool that includes a tubular body defining a longitudinal axial cavity extending therethrough. The tubular body also defines at least one radial guidance channel extending radially from the axial cavity through the tubular body. A cutter element is disposed in the at least one radial guidance channel and includes an internal surface inclined at an angle to a longitudinal axis of the tubular body. The drilling tool also includes a wedge element having an external surface configured to engage the internal surface of the cutter element and to direct the cutter element from a retracted position to an extended position as the wedge element moves from a first position to a second position.

19 Claims, 9 Drawing Sheets

U.S. PATENT DOCUMENTS

| | | | | |
|---|---|---|---|---|
| 2,450,223 | A | 9/1948 | Barbour | 175/271 |
| 2,499,916 | A | 3/1950 | Harris | 175/276 |
| 2,710,172 | A | 6/1955 | Kammerer, Jr. | 175/268 |
| 2,754,089 | A | 7/1956 | Kammerer, Jr. | 175/268 |
| 2,758,819 | A | 8/1956 | Kammerer, Jr. | 255/76 |
| 2,809,015 | A | 10/1957 | Phipps | 175/232 |
| 2,822,150 | A | 2/1958 | Muse et al. | 175/266 |
| 2,834,578 | A | 5/1958 | Carr | 255/73 |
| 2,872,160 | A | 2/1959 | Barg | 175/269 |
| 2,882,019 | A | 4/1959 | Carr et al. | 255/73 |
| 3,105,562 | A | 10/1963 | Stone et al. | 175/268 |
| 3,123,162 | A | 3/1964 | Rowley | 175/325.4 |
| 3,180,436 | A | 4/1965 | Kellner et al. | 175/57 |
| 3,224,507 | A | 12/1965 | Cordary et al. | 166/55.8 |
| 3,351,144 | A | 11/1967 | Park | 175/269 |
| 3,365,010 | A | 1/1968 | Howell et al. | 175/286 |
| 3,425,500 | A | 2/1969 | Fuchs | 175/269 |
| 3,433,313 | A | 3/1969 | Brown | 175/270 |
| 3,556,233 | A | 1/1971 | Gilreath et al. | 175/267 |
| 3,749,184 | A | 7/1973 | Andeen | 175/18 |
| 3,974,886 | A | 8/1976 | Blake, Jr. | 175/76 |
| 4,055,226 | A | 10/1977 | Weber | 175/273 |
| 4,081,042 | A | 3/1978 | Johnson et al. | 175/267 |
| 4,091,883 | A | 5/1978 | Weber | 175/287 |
| 4,141,421 | A | 2/1979 | Gardner | 175/263 |
| 4,177,866 | A | 12/1979 | Mitchell | 175/53 |
| 4,186,810 | A | 2/1980 | Allan | 175/96 |
| 4,190,124 | A | 2/1980 | Terry | 175/406 |
| 4,411,557 | A | 10/1983 | Booth | 405/238 |
| 4,458,761 | A | 7/1984 | Van Vreeswyk | 166/289 |
| 4,503,919 | A | 3/1985 | Suied | 175/269 |
| 4,589,504 | A | 5/1986 | Simpson | 175/267 |
| 4,660,657 | A | 4/1987 | Furse et al. | 175/269 |
| 4,821,817 | A | 4/1989 | Cendre et al. | 175/269 |
| 4,842,083 | A | 6/1989 | Raney | 175/325.4 |
| 4,889,197 | A | 12/1989 | Bøe | 175/267 |
| 4,915,181 | A | 4/1990 | Labrosse | 175/263 |
| 5,010,967 | A | 4/1991 | Desai | 175/406 |
| 5,036,921 | A | 8/1991 | Pittard et al. | 166/298 |
| 5,060,738 | A | 10/1991 | Pittard et al. | 175/267 |
| 5,086,852 | A | 2/1992 | Van Buskirk | 175/269 |
| 5,139,098 | A | 8/1992 | Blake | 175/269 |
| 5,184,687 | A | 2/1993 | Abdrakhmanov et al. | 175/267 |
| 5,255,741 | A | 10/1993 | Alexander | 166/278 |
| 5,265,684 | A | 11/1993 | Rosenhauch | 175/61 |
| 5,271,472 | A | 12/1993 | Leturno | 175/107 |
| 5,318,137 | A | 6/1994 | Johnson et al. | 175/40 |
| 5,318,138 | A | 6/1994 | Dewey et al. | 175/74 |
| 5,330,016 | A | 7/1994 | Paske et al. | 175/320 |
| 5,332,048 | A | 7/1994 | Underwood et al. | 175/26 |
| 5,348,095 | A | 9/1994 | Worrall et al. | 166/380 |
| 5,368,114 | A | 11/1994 | Tandberg et al. | 175/267 |
| 5,560,440 | A | 10/1996 | Tibbitts | 175/384 |
| 5,590,724 | A | 1/1997 | Verdgikovsky | 175/57 |
| 5,655,609 | A | 8/1997 | Brown et al. | 175/76 |
| 5,788,000 | A | 8/1998 | Maury et al. | 175/325.1 |
| 5,957,222 | A | 9/1999 | Webb et al. | 175/45 |
| 5,957,226 | A | 9/1999 | Holte | 175/320 |
| 6,059,051 | A | 5/2000 | Jewkes et al. | 175/76 |
| 6,070,677 | A | 6/2000 | Johnston, Jr. | 175/57 |
| 6,131,675 | A | 10/2000 | Anderson | 175/268 |
| 6,189,631 | B1 | 2/2001 | Sheshtawy | 175/284 |
| 6,209,665 | B1 | 4/2001 | Holte | 175/273 |
| 6,213,226 | B1 | 4/2001 | Eppink et al. | 175/61 |
| 6,244,664 | B1 | 6/2001 | Ebner et al. | 299/80.1 |
| 6,269,893 | B1 | 8/2001 | Beaton et al. | 175/391 |
| 6,289,999 | B1 | 9/2001 | Dewey et al. | 175/38 |
| 6,360,830 | B1 | 3/2002 | Price | 175/52 |
| 6,360,831 | B1 | 3/2002 | Åkesson et al. | 175/269 |
| 6,378,632 | B1 | 4/2002 | Dewey et al. | 175/269 |
| 6,419,025 | B1 | 7/2002 | Lohbeck et al. | 166/380 |
| 6,427,788 | B1 | 8/2003 | Rauchenstein | 175/269 |
| 6,464,124 | B2 | 10/2003 | Beaton et al. | 228/19 |
| 6,668,949 | B1 | 12/2003 | Rives | 175/269 |
| 6,732,817 | B2 | 5/2004 | Dewey | 175/57 |
| 2003/0079913 | A1 | 5/2003 | Eppink et al. | 175/61 |
| 2003/0155155 | A1 | 8/2003 | Dewey et al. | 175/57 |
| 2004/0065479 | A1 | 4/2004 | Fanuel | 175/267 |
| 2004/0065480 | A1 | 4/2004 | Fanuel et al. | 175/269 |
| 2004/0134687 | A1 | 7/2004 | Radford et al. | 175/57 |

FOREIGN PATENT DOCUMENTS

| | | | |
|---|---|---|---|
| DE | 2 839 868 | A1 | 4/1979 |
| EP | 0 086 701 | A1 | 8/1983 |
| EP | 0 301 890 | A2 | 2/1989 |
| EP | 0 577 545 | A1 | 3/1993 |
| EP | 0 568 292 | A1 | 11/1993 |
| FR | 569203 | | 4/1924 |
| GB | 218774 | | 7/1924 |
| GB | 295150 | | 8/1928 |
| GB | 540027 | | 10/1941 |
| GB | 1 586 163 | | 3/1981 |
| GB | 2 128 657 | A | 5/1984 |
| GB | 2 180 570 | A | 4/1987 |
| NL | 8 503 371 | | 7/1987 |
| WO | WO 00/31371 | | 6/2000 |
| WO | WO 02/072994 | A1 | 9/2002 |

OTHER PUBLICATIONS

PCT International Preliminary Examination Report for International Application No. PCT/BE/00031; filed Mar. 12, 2002, Jun. 17, 2003.

UK Search Report for GB Application No. GB 0323195.8 from (1 page), Dec. 11, 2003.

Belgium Search Report for International Application No. PCT/BE02/00031, (3 pages—including cover letter dated Oct. 5, 2004), Sep. 17, 2004.

Notification of International Search Report and Written Opinion for International Application No. PCT/BE2004/000057, filed Apr. 21, 2004 (11 pages), Dec. 21, 2004.

Notification of International Search Report and Written Opinion for International Application No. PCT/BE2004/000083, filed Jun. 9, 2004 (11 pages), Dec. 21, 2004.

PCT/EP2005/052613, 3 pgs, Jun. 7, 2005.

* cited by examiner

UNDERREAMING AND STABILIZING TOOL AND METHOD FOR ITS USE

CROSS-REFERENCE TO RELATED APPLICATIONS

This application is a Continuation-in-Part of International Patent Application Ser. No. PCT/BE2004/000057 entitled "Underreaming and Stabilizing Tool and Method for Its Use" filed on Apr. 21, 2004.

TECHNICAL FIELD OF THE INVENTION

This invention relates in general to earth formation drilling tools and methods, and more particularly to an underreaming and stabilizing tool to be put into service in a drilling hole and a method for its use.

BACKGROUND OF THE INVENTION

Earth formation drilling is often accomplished using a long string of drilling pipes and tools coupled together. The drilling string is rotated together in order to rotate a cutting bit at the end of the string. This cutting bit creates the hole which the rest of the drilling string moves through. For various reasons, it may be desirable to widen the walls of the hole after it has been created by the cutting bit. Bore-hole underreamers exist to accomplish the widening of the hole. An underreamer may be coupled to the drilling string between two other elements of the drilling string. It may then be sent down hole with the drilling string, rotating with the drilling string, and widening the hole.

Various underreamer designs exist. Some have fixed cutting blades around the periphery of the underreamer and some have expandable blades or arms. Various types and hardness of earth formations also exist. Aggressive blades, extending quickly and/or relatively far beyond the periphery of the underreamer body, may be used in soft formations; and less aggressive blades, extending more slowly and/or a shorter distance beyond the periphery of the underreamer body, may be used in harder formations. Different types of formations may exist down the length of a drilling hole, and it may be desirable to widen the hole through each of these formation types. If the blades or arms with which the underreamer is equipped are not suitable for the types of formations being widened, the underreamer may need to be replaced. This generally involves pulling the drill string up from the hole, disconnecting the underreamer, and connecting an underreamer equipped with blades or arms that are suitable for the formation type. This may require a drilling operator to have several underreamers on hand as well as the tools required to change underreamers. The increased inventory requires a greater capital investment, more storage space, and greater maintenance costs than having a single underreamer.

Over the lifetime of the underreamer the blades or arms of the underreamer may become worn. When the underreamer is no longer able to perform a widening of the drilling hole, it may be withdrawn from the drilling hole and disconnected from the drilling string. A new underreamer may be put in its place, and the worn underreamer may be sent for retooling and refurbishment. Sending the worn underreamer away for retooling and refurbishment may result in costly down time or increased inventory and maintenance costs by requiring a replacement underreamer to be kept available.

SUMMARY OF THE INVENTION

In accordance with the present invention, the disadvantages and problems associated with underreamer cutter wear and replacement have been substantially reduced or eliminated. In particular, an underreamer is provided in which the cutter arms may be easily replaced, thereby reducing the number of different underreamers which need to be kept on hand, and reducing costly downtime.

Particular embodiments of the present invention may provide a drilling tool that includes a tubular body defining a longitudinal axial cavity extending therethrough. The tubular body also defines at least one radial guidance channel extending radially from the axial cavity through the tubular body. A cutter element is disposed in the at least one radial guidance channel and includes an internal surface inclined at an angle to a longitudinal axis of the tubular body. The drilling tool also includes a wedge element having an external surface configured to engage the internal surface of the cutter element and to direct the cutter element from a retracted position to an extended position as the wedge element moves from a first position to a second position.

Certain embodiments of the present invention may also include a drive pipe disposed within the axial cavity and coupled to the wedge element. The drive pipe may be configured to move the wedge element from the first position to the second position as the drive pipe moves from a first longitudinal position to a second longitudinal position. Certain embodiments may also include the drive pipe defining a longitudinal slot along an intermediate portion of the drive pipe. The drive pipe may also define a peripheral slot disposed adjacent a first end of the longitudinal slot. The drive pipe may be configured to permit the wedge element to slide within the longitudinal slot when the drive pipe is in a first angular position and to fixedly couple the wedge element to the peripheral slot of the drive pipe as the drive pipe is rotated from the first angular position to a second angular position. In another particular embodiment the drive pipe may define at least a first longitudinal groove having a length corresponding to a distance between the first and second longitudinal positions of the drive pipe. The tubular body may further define at least a first aperture aligning with the first longitudinal groove when the drive pipe is in the second angular position. A generally cylindrical immobilizing element may pass through the first aperture and protrude into the first longitudinal groove.

A method according to the one embodiment of the present invention may include installing a cutter element and a wedge element at least partially within a radial guidance channel of a tubular body by passing the cutter element through a longitudinal axial cavity of the tubular body. The cutter element and the wedge element may then be moved radially outward from the longitudinal axial cavity at least partially into the radial guidance channel. The cutter element may be moved from a retracted position to an extended position by moving the wedge element from a first longitudinal position to a second longitudinal position.

Certain embodiments may include coupling the wedge element to the cutter element before installing the cutter element and the wedge element at least partially within the radial guidance channel. Another particular embodiment may include installing the drive pipe in the axial cavity by: orienting the drive pipe in a first angular position, inserting an end of the drive pipe into an end of the tubular body, sliding the drive pipe into the axial cavity, and rotating the drive pipe to a second angular position.

A particular alternative embodiment of the present invention may include increasing a fluid pressure of a drilling fluid circulating inside an axial cavity of a tubular body. A surface pressure on a piston of a drive pipe disposed within the axial cavity of the tubular body is increased by increasing the fluid pressure of the drilling fluid. A longitudinal movement of the drive pipe and a wedge element coupled to the drive pipe is achieved by increasing the surface pressure on the piston. And a radial movement of a cutter element disposed in a radial guidance channel of the tubular body is achieved by directing the longitudinal movement of the drive pipe and the wedge element.

Technical advantages of certain embodiments of the present invention include an underreamer with cutter elements which are easily replaced, yet held securely within the underreamer. The cutter elements are installed from the inside of the body of the underreamer into radial guidance channels which prevent the cutter elements from extending past a designed extension point. In this manner, the cutter elements of the underreamer may be easily changed to less worn cutter elements or to cutter elements which are more appropriate for a particular formation type. This feature may reduce or eliminate the need to keep multiple underreamers available.

Additional technical advantages of the present invention include radially movable cutter elements which move in response to fluid pressure changes. The fluid pressure acting on the cutter elements may be increased to extend the cutter elements and decreased to cause a retraction of the cutter elements.

Further technical advantages of the present invention include activation and deactivation devices. The activation device keeps the cutter elements in a retracted position until underreaming is desired, and the deactivation device keeps the cutter elements in the retracted position after underreaming is complete. In this manner, the underreamer is not activated when underreaming is not desired. This also avoids unnecessary wear on the underreamer.

Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
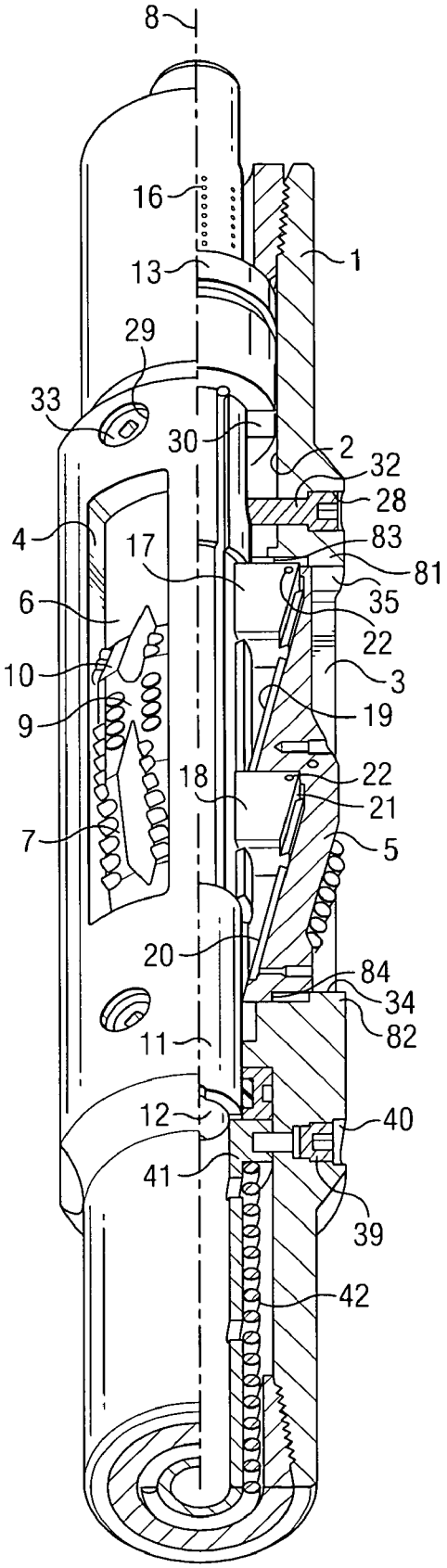
FIG. 1 is a perspective view, with portions broken away, illustrating an underreaming and stabilizing tool having cutter elements in a retracted position, in accordance with the teachings of the present invention.

The present invention relates to an underreaming and stabilizing tool to be used in a drilling hole. The tool includes a tubular body suitable for coupling with a drilling string and/or other drilling tools. The tubular body may have an axial cavity which is open towards the outside through at least one radial guidance channel. A cutter element may be arranged so as to be movable radially in each radial guidance channel. The tool also includes wedges that, through a longitudinal movement inside the tubular body, lead to radial motion of each cutter element in its radial guidance channel.

It has become increasingly necessary, during drilling in hard and abrasive geological formations, to have underreaming tools provided with many cutter elements having the form of large arms. The underreaming arms are increasingly elongated and equipped with a high number of cutting tips. The underreaming arms underream the drilling hole during a descent of the tool downwards and may be provided with reinforced diamond dome parts for stabilizing the tool during underreaming and parts for underreaming the hole while raising the underreaming tool towards the surface.

The tools currently available have the drawback of being suitable only for use in one type of geological formation. Upon a change of geological formation, the underreaming tool must be completely replaced. The whole tool must be extracted from the drilling sting and replaced with another tool whose configuration is better suited for underreaming the drilling hole in the new geological formation. The same applies in the case of wear or failure of the cutter elements. This results in a significant operating cost.

The teachings of the present invention provide an underreaming and stabilizing tool that provides increased flexibility according to the geological formations in which it is used, and ease of replacement of the cutter elements due to wear.

The previously enumerated problems have been solved by an underreaming and stabilizing tool which includes a drive pipe mounted inside the axial cavity so as to move longitudinally therein. The drive pipe has a longitudinal axis about which it is capable of pivoting. The tool also includes at least one wedge element per cutter element. Each wedge element is supported in a detachable manner at the periphery of the drive pipe. Each wedge element and the drive pipe are, in a first angular position of the drive pipe, capable of moving independently longitudinally. In a second angular position of the drive pipe, each wedge element is held by the drive pipe such that each wedge element moves longitudinally with the drive pipe. The tool also includes detachable stopping mechanisms which are capable of immobilizing the drive pipe in its second angular position, while allowing its longitudinal movements.

This tool, therefore, allows easy replacement of the wedge elements by allowing detachment from the drive pipe on which the wedge elements are supported. Therefore it is possible without difficulty to replace the wedge elements with other wedge elements having a different configuration. Faced with a hard geological formation, cutter elements can be provided that react with more flexibility during underreaming because they rest on wedge elements with a steep slope. Faced with a crumbly geological formation, there can be provided, in the same tool, cutter elements that retract more slowly, since the wedge elements will then be provided with a gentler slope. Such a conversion of the tool therefore requires only replacement of the wedge elements and substitution of the cutter elements with other cutter elements adapted to the replaced wedge elements. Thus, there can also be provided, in the same radial guidance channels, cutter elements having different active lengths without having to change tools.

Moreover, upon wear of the cutter elements, the cutter elements can be replaced quickly, as will be described in a more detailed manner below.

According to one embodiment of the invention, a stopping mechanism may be provided that may comprise at least one aperture in the tubular body and at least one groove extending longitudinally on the periphery of the drive pipe over a length corresponding to the desired longitudinal sliding of the drive pipe. When the drive pipe is in the second angular position, the groove faces the at least one aperture. The stopping mechanism may also include an immobilizing element passed through the at least one aperture in order to enter the at least one groove to immobilize the drive pipe in its second angular position without preventing its longitudinal movements. In order to allow, on a single tool, easy adjustment of the permitted longitudinal travel for the drive pipe, provision has been made, according to the invention, that the stopping mechanism comprises a number of apertures and a corresponding number of grooves which have mutually different lengths. According to the required sliding length of the drive pipe, the immobilizing element is passed through the aperture situated facing the appropriate groove. The tool also comprises a way of closing off the unused apertures. For example, if the required slope of the wedge elements must be steeper or if the radial movement of the cutter elements protruding out of the body of the tool must be small, it is sufficient to limit the longitudinal movement of the drive pipe by introducing the immobilizing element into a groove having a relatively shorter length.

According to one embodiment of the invention, the inclined internal surface of each cutter element and the inclined external surface of each wedge element on which the cutter element rests are provided with mutual holding mechanisms in the radial direction. The holding mechanisms are arranged so that the cutter element in the high position in its radial guidance channel performs a radial descent to a low position by retraction on the part of the holding mechanisms of said at least one wedge element during the longitudinal movement thereof. The pressure of the cutter elements radially outwards and the retraction thereof inside the tubular body therefore result solely from cooperation between wedge elements and a corresponding cutter element, confined in a channel which is used solely for radial guidance. The result of this is that, irrespective of the slope of the cooperating surfaces of the wedge elements and the cutter element, the length of the latter or the required extension thereof out of the body of the tool, the tubular body and the drive pipe remain the same.

According to one embodiment of the invention, the drive pipe comprises a piston which separates, in the tubular body, a first section in which a hydraulic fluid is under an internal pressure and a second section, which is in communication with the outside through said at least one radial guidance channel where the at least one wedge element and corresponding cutter element are housed. By a simple difference in pressure applied between two sections of the tubular body, it is possible to drive the wedge elements longitudinally and put the cutter elements into service for underreaming the hole and/or stabilizing the tool in this hole.

The present invention also concerns a method for using an underreaming and stabilizing tool to be put into service in a drilling hole. The method may include axial introduction of each cutter element equipped with at least one wedge element into the axial cavity of the tubular body facing a corresponding radial guidance channel. Each cutter element, equipped with its at least one wedge element, may be positioned and held in its radial guidance channel. The method may then include introduction of the drive pipe into the axial cavity of the tubular body, in a first angular position, and relative sliding between this drive pipe and said at least one radially fitted wedge element, as far as an appropriate position. The method may then include pivoting the drive pipe to a second angular position in which it is capable of driving said at least one wedge element in its longitudinal movements. The drive pipe may be immobilized in this second angular position, while still allowing its longitudinal movements.

Such a method allows a particularly easy and quick mounting and dismantling of the tool by axial introduction of all the other elements into the cavity of the tubular body. A simple rotation of the drive pipe immobilizes the wedge elements on the drive pipe in the longitudinal direction. Next, a simple immobilization of the drive pipe in its new angular position immediately allows the tool to be put into service.

Furthermore, introduction of the cutter elements axially, or through the inside of the tubular body, reduces or eliminates the risk of them becoming detached from the tool during operation. This is because the cutter elements are immobilized in their radial guidance channel, for example, by appropriate limit stops that prevent the portions of the cutter elements interacting with the limit stops from extending radially past the limit stops.

According to a further embodiment, the method also comprises, before the step of axial introduction of each cutter element, arranging on at least one inclined internal surface of each cutter element at least one wedge element having an external surface inclined in the same way. During axial introduction, the cutter element and the wedge element remain fixed to one another by, for example, a shear pin. The wedge element and the cutter element may be separated during drilling by a threshold hydraulic pressure of a drilling fluid acting on a piston of the drive pipe sufficient to shear the shear pin.

Other details and particular features of the invention will emerge from the description given below on a non-limiting basis and with reference to the accompanying drawings.

Figure 2:
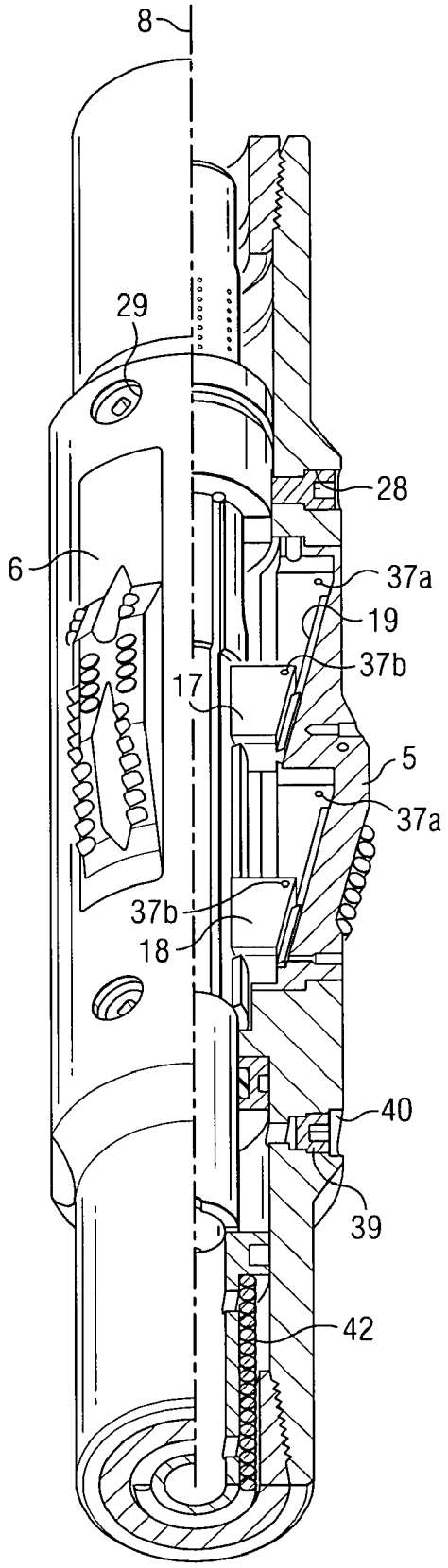
FIG. 2 is a perspective view, with portions broken away, illustrating the underreaming and stabilizing tool of FIG. 1, having cutter elements in a deployed position.

As illustrated in FIGS. 1 and 2, the tool according to the invention comprises a tubular body 1 which is mounted between two sections of a drilling string (not depicted). Tubular body 1 has a longitudinal axial cavity 2, extending therethrough, that is open towards the outside through three radial guidance channels, of which only two, radial guidance channel 3 and radial guidance channel 4, are visible in the figures. Alternative embodiments may include any suitable number of radial guidance channels.

In each radial guidance channel 3 and 4, a cutter element 5 and 6, respectively, is arranged so as to be movable radially, with respect to a longitudinal central axis 8 of the tubular body 1. Each cutter element comprises, in the example illustrated, an external surface equipped with cutting tips which has a front part 7 inclined towards the front with respect to longitudinal axis 8, a central part 9 substantially parallel to the axis 8, and a rear part 10 inclined towards the rear with respect to axis 8. Front part 7 is intended to produce an underreaming of the drilling hole during its descent. Central part 9 is intended to stabilize the tool with respect to the underreamed hole. Rear part 10 is intended to produce an underreaming of the drilling hole during raising of the drilling string.

For the purposes of this description, longitudinal movement is defined as movement at least substantially parallel to the longitudinal axis 8. Radial movement is defined as movement at least substantially perpendicular to, or in a plane at least substantially perpendicular to, longitudinal axis 8.

The tool according to the invention also comprises a drive pipe 11 mounted inside axial cavity 2 so as to be able to perform longitudinal movements therein according to a hydraulic pressure. Drive pipe 11 is also capable of pivoting or rotating about the aforementioned longitudinal axis 8.

Figure 4:
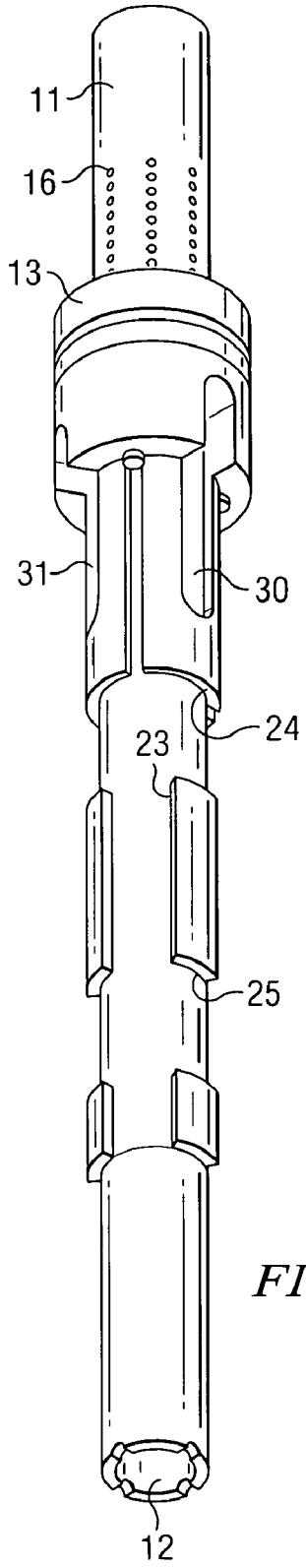
FIG. 4 is a perspective view illustrating the drive pipe of FIG. 3 without the wedge elements and the cutter elements.
Figure 7:
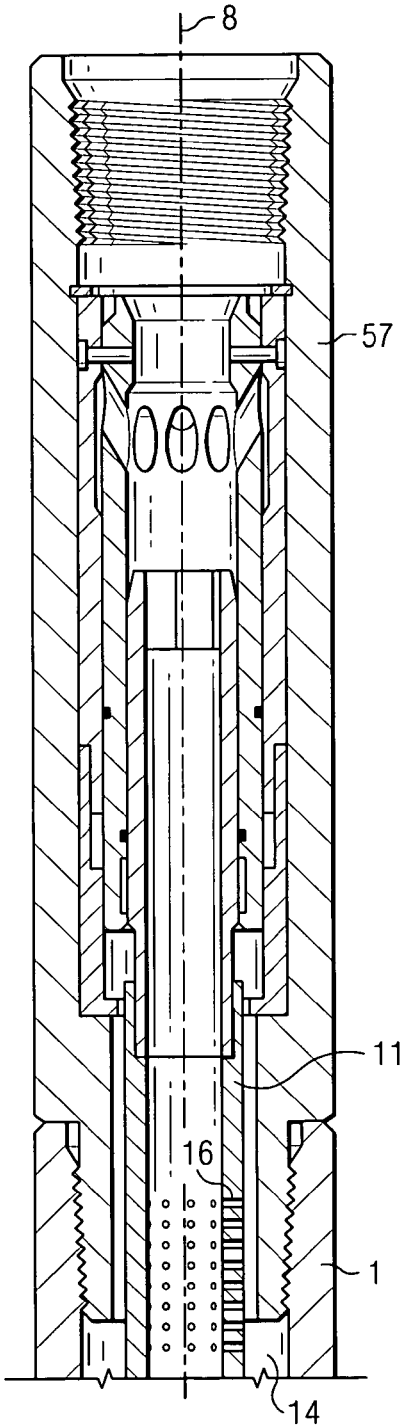
FIG. 7 is a longitudinal cross section view of the top, or upstream, portion of the underreaming and stabilizing tool of FIG. 1, illustrating the upstream joining element for coupling the upstream portion of the tool with the drill string.

As illustrated in FIG. 4, drive pipe 11 also has an axial cavity 12 through which the drilling mud can circulate. Drive pipe 11 comprises a piston 13 which separates a first section 14 of tubular body 1 (see FIG. 7) and a second section 15 of tubular body 1 (see FIG. 8). A fluid under hydraulic pressure can enter into first section 14, for example from axial cavity 12 of drive pipe 11, by passing through a filter formed by piercings 16. Second section 15 of tubular body 1 is in communication with the well bore through radial guidance channels 3 and 4 where cutter elements 5 and 6 are housed.

The tool according to the invention also comprises, in the example illustrated, two wedge elements 17 and 18 per cutter element 5 and 6. These wedge elements are supported by drive pipe 11. In alternative embodiments, there could be provided a single wedge element per cutter element or more than two wedge elements per cutter element, according to operational requirements.

Each cutter element 5 and 6 may have at least one inclined internal surface disposed at an angle to longitudinal axis 8. In the example implementation illustrated, cutter element 5 has two inclined internal surfaces 19 and 20. Each wedge element 17 and 18 may have an inclined external surface 21 corresponding to inclined internal surfaces 19 and 20 that rests on the internal surface 19 or 20 of the corresponding cutter element.

Figure 10:
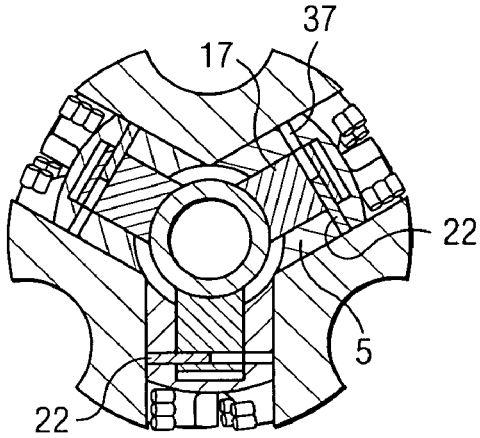
FIG. 10 is a radial cross section view of the underreaming and stabilizing tool of FIG. 1 through the 10-10 line of FIG. 8.
Figure 11:
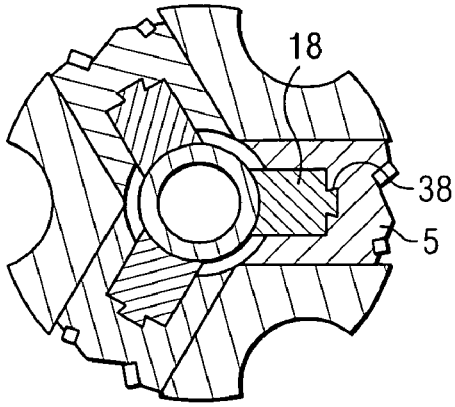
FIG. 11 is a radial cross section view of the underreaming and stabilizing tool of FIG. 1 through the 11-11 line of FIG. 8.

As illustrated in FIGS. 10 and 11, each cutter element 5 has a generally U-shaped cross-section straddling the corresponding wedge elements 17 and 18. The surfaces 19 and 20 of the cutter elements and the surface 21 of the wedge element have mutual holding mechanisms in the radial direction which, in the example illustrated, are each in the form of a dovetail slot and a molding 38 of corresponding shape.

Furthermore, for mounting, each wedge element is fixed on its respective cutter element by a shear pin 22 (see FIGS. 1 and 10). The shear pins 22 hold the wedge elements with respect to the cutter elements in the position illustrated in FIG. 1. To do this, shear pins 22 are introduced into a perforation 37*a* provided for that purpose in cutter element 5 and a corresponding perforation 37*b* in wedge elements 17 and 18 (see FIGS. 2 and 10).

Figure 3:
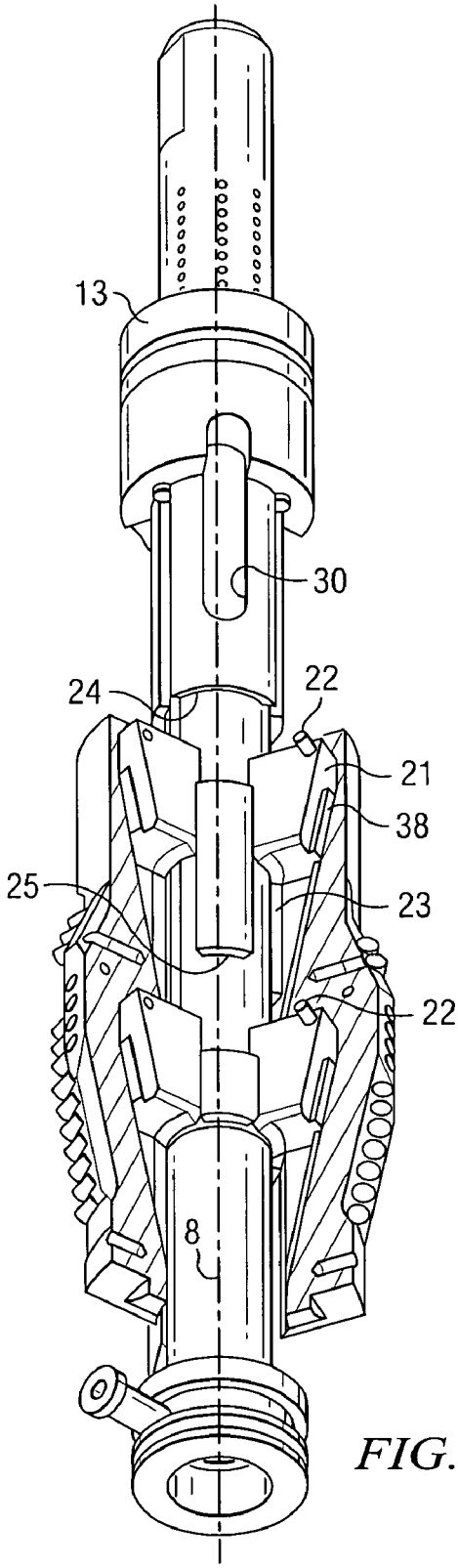
FIG. 3 is a perspective view illustrating a drive pipe of the underreaming and stabilizing tool of FIG. 1, equipped with wedge elements and cutter elements.

Referring to FIG. 4, it can be seen that drive pipe 11 is provided at its periphery with longitudinal slots 23 in which the wedge elements 17 and 18 can perform a relative longitudinal sliding motion with respect to drive pipe 11, as depicted in FIG. 3.

Figure 6:
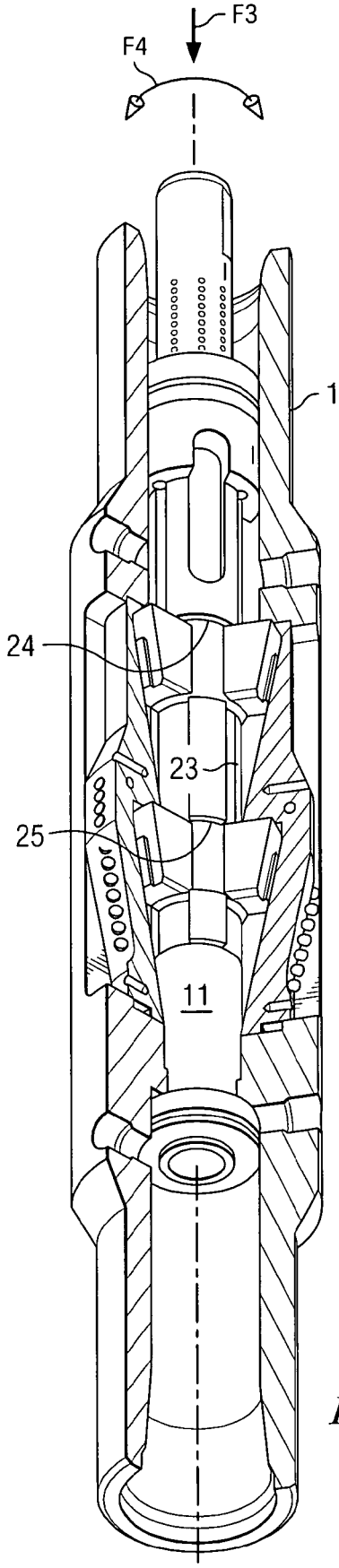
FIG. 6 is a perspective view, with portions broken away, of the underreaming and stabilizing tool of FIG. 1, illustrating the installation of the drive pipe into the body of the tool.

Drive pipe 11 also has at its periphery peripheral slots 24 and 25 into each of which a wedge element 17 or 18 can move when the drive pipe is caused to pivot about its axis 8 between a first angular position illustrated in FIGS. 3 and 6 and a second angular position illustrated in FIGS. 1 and 2.

Figure 8:
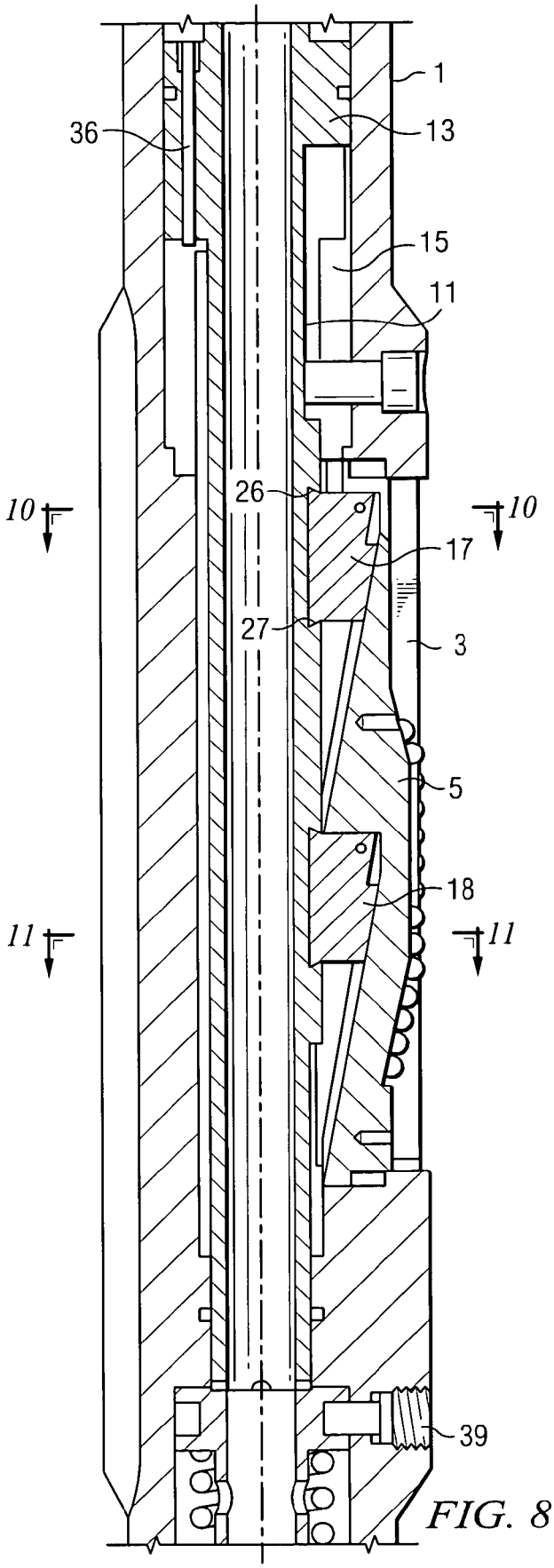
FIG. 8 is a longitudinal cross section view of the middle portion of the underreaming and stabilizing tool of FIG. 1, illustrating the wedge elements, cutter elements, and a portion of the drive pipe.

In this second angular position, wedge elements 17 and 18 are held radially inside peripheral slots 24 and 25, respectively, as a result of the peripheral slots having a dovetail-shaped cross-section and the edges of wedge elements 17 and 18 widening out in a corresponding manner at 26 and 27 (see FIG. 8). In the second angular position of the drive pipe, illustrated in FIGS. 1 and 2, wedge elements 17 and 18 are therefore immobilized longitudinally with respect to drive pipe 11, and they accompany drive pipe 11 in its longitudinal movements.

The tool may also comprise detachable stopping mechanisms which are capable of immobilizing drive pipe 11 in its second angular position while allowing its longitudinal movements. These stopping mechanisms may comprise at least one aperture in tubular body 1 and at least one groove which extends longitudinally on the periphery of drive pipe 11. In the example illustrated, drive pipe 11 is provided with three apertures and three grooves. Two apertures 28 and 29 are depicted in particular in FIGS. 1 and 2, and two grooves 30 and 31 are depicted in particular in FIGS. 1 and 4. A different number of apertures and grooves can of course be imagined. In the example illustrated, these grooves have different lengths, as groove 31 is shorter than groove 30. In the second angular position of drive pipe 11, each groove 30 and 31 is situated facing a corresponding aperture 28 and 29.

The aforementioned stopping mechanisms also comprise an immobilizing element 32 that passes through aperture 28 situated facing groove 30. Immobilizing element 32 passes into groove 30 and thereby prevents drive pipe 11 from performing a pivoting motion while not hindering its longitudinal sliding within the limits imposed by the length of groove 30. A drive pipe 11 including grooves of differing lengths allows selection of the length of longitudinal displacement of drive pipe 11. The longitudinal displacement of drive pipe 11 may be adjusted to achieve the desired radial displacement of cutter element 5 given the slope of wedge elements 17 and 18. The longitudinal displacement is selected by installing the immobilizing element 32 into the aperture corresponding to the groove having a length substantially equal to the desired length of longitudinal displacement. Once the immobilizing element 32 has been installed, the other apertures may be equipped with plugs 33.

During its longitudinal sliding, drive pipe 11 is brought from the position depicted in FIG. 1 to the position depicted in FIG. 2. It drives with it wedge elements 17 and 18 which then lead to radial motion of each cutter element 5 and 6 in their radial guidance channel 3 and 4. Cutter elements 5 and 6 are immobilized against any longitudinal movement by front wall 34 and rear wall 35 of their radial guidance channels 3 and 4. Therefore cutter elements 5 and 6 perform an extending or retracting motion within radial guidance channels 3 and 4 between the low (retracted) position illustrated in FIG. 1 and the high (extended) position illustrated in FIG. 2. Front wall 34 and rear wall 35 may include raised ridges 81 and 82 at the ends of the radial guidance channels 3 and 4. Raised ridges 81 and 82 have corresponding shapes with cutouts in cutter elements 5 partially defined by surfaces 83 and 84. As cutter element 5 moves from the retracted position to the extended position, surface 83 will abut raised ridge 81 and surface 84 will abut raised ridge 82. Together, raised ridges 81 and 82 and surfaces 83 and 84 define a maximum radial extension of the cutter elements 5 and 6.

Advantageously, piston 13 has a passage in the form of at least one duct 36 of small diameter (see FIG. 8) that allows communication between section 14 under pressure (see FIG. 7) and section 15 (see FIG. 8), which is in communication with the well bore. The narrowing implemented by duct 36 results in an injection under high pressure of jets of hydraulic fluid into section 15. This makes it possible to prevent entry into the tool of the drilling mud which circulates outside the drilling string and to clean wedge elements 17 and 18, cutter elements 5 and 6, and radial guidance channels 3 and 4.

Figure 5:
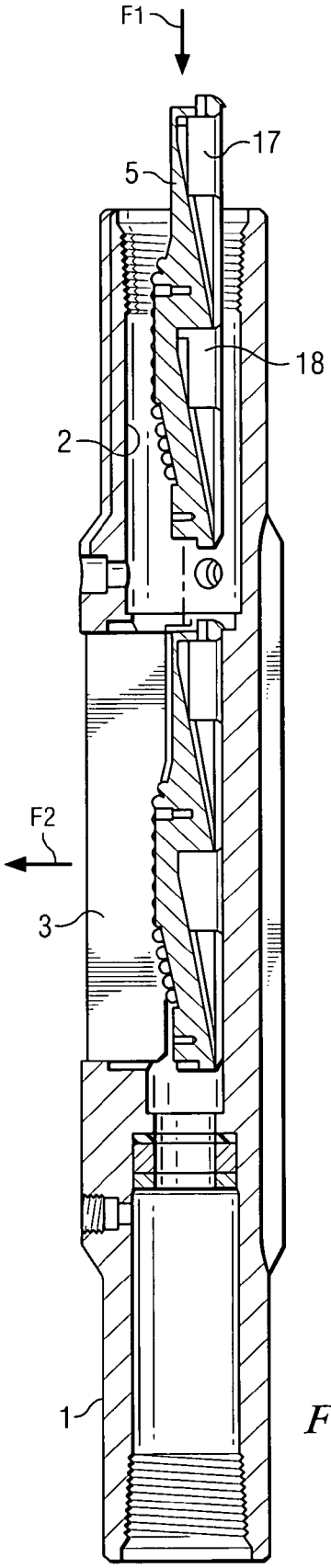
FIG. 5 is a longitudinal cross section view of the underreaming and stabilizing tool of FIG. 1, illustrating the installation of a cutter element and wedge element assembly into the body of the tool.

As illustrated in FIG. 5, each cutter element 5 is equipped with two wedge elements 17 and 18. For this, dovetail moldings 38 of wedge elements 17 and 18 are slipped inside the corresponding dovetail slots of cutter elements 5 and 6. Each wedge element 17 and 18 is fixed to its respective cutter element 5 and 6 with a shear pin 22. For each wedge element 17 and 18, its respective shear pin 22 passes through wedge element 17 or 18 and at least one aperture 37 provided in cutter element 17 or 18 (see FIG. 10). Thus, wedge elements 17 and 18 and cutter elements 5 and 6 remain fixed together during the mounting operations.

Cutter elements 5 and 6, equipped with their two wedge elements, are then introduced axially inside axial cavity 2 of tubular body 1 in the direction of arrow F1 of FIG. 5, where cutter element 5 is depicted in two successive introduction positions. When cutter element 5 appears facing its corresponding radial guidance channel 3, cutter element 5 is pulled radially towards the outside in the direction of arrow F2, manually or by a machine, and is kept in this fitted position.

The next step is illustrated in FIG. 6. Drive pipe 11 is introduced into axial cavity 2 of tubular body 1 in the direction of arrow F3. During this introduction, drive pipe 11 is situated in its first angular position, which allows wedge elements 17 and 18 to slide in longitudinal slots 23 of drive pipe 11. FIGS. 3 and 6 illustrate this position, which allows relative longitudinal sliding between wedge elements 17 and 18 and drive pipe 11.

When wedge elements 17 and 18 arrive facing peripheral slots 24 and 25, drive pipe 11 is pivoted about axis 8 according to the double arrow F4 of FIG. 6 in order to reach the second angular position illustrated in FIGS. 1 and 2. Wedge elements 17 and 18 are, in this angular position, driven by drive pipe 11 when drive pipe 11 slides longitudinally in tubular body 1.

Drive pipe 11 can be immobilized in its second angular position by immobilizing element 32. Immobilizing element 32 is passed through an appropriate aperture, for example aperture 28, and a groove, for example groove 30, whose length corresponds to the sliding length chosen for the application of the tool.

As noted, the mounting and the dismantling of the tool is relatively simple and quick. Cutter elements 5 and 6 can easily be replaced with new cutter elements, and other models of cutter elements can be introduced into the tool without having to replace the entire tool.

The tool according to the invention also comprises an activation device which is capable of keeping drive pipe 11 in its initial position depicted in FIG. 1. In the example illustrated in FIGS. 1 and 2, the activation device comprises a shear pin 39 which passes through an aperture 40 provided in tubular body 1 and enters a blind hole provided on an extension pipe 41 connected in a fixed manner to drive pipe 11. When the hydraulic pressure applied to piston 13 is below a given threshold, shear pin 39 prevents any longitudinal movement in the tubular body. When this threshold is exceeded, shear pin 39 is sheared off as illustrated in FIG. 2, and drive pipe 11 can slide in tubular body 1.

Figure 9:
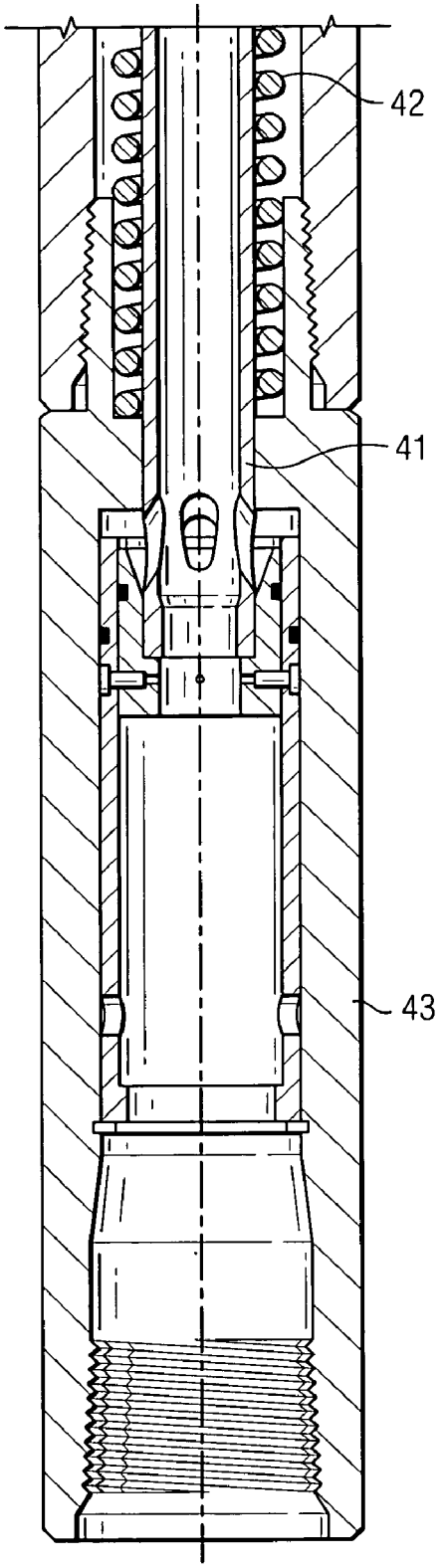
FIG. 9 is a longitudinal cross section view of the middle portion of the underreaming and stabilizing tool of FIG. 1, illustrating the downstream joining element for coupling the downstream portion of the tool with the drill string.

As can be seen in particular in FIGS. 8 and 9, the tool according to the invention is also equipped, in the example illustrated, with a return spring 42 resting on the one hand on extension pipe 41 fixed with drive pipe 11 and on the other hand on a joining element 43 fixed on tubular body 1. When, under the action of pressure, drive pipe 11 is moved, return spring 42 is compressed as depicted in FIG. 2. When the pressure decreases, drive pipe 11 is brought back to its initial position illustrated in FIG. 1 by the extension of return spring 42.

Figure 12:
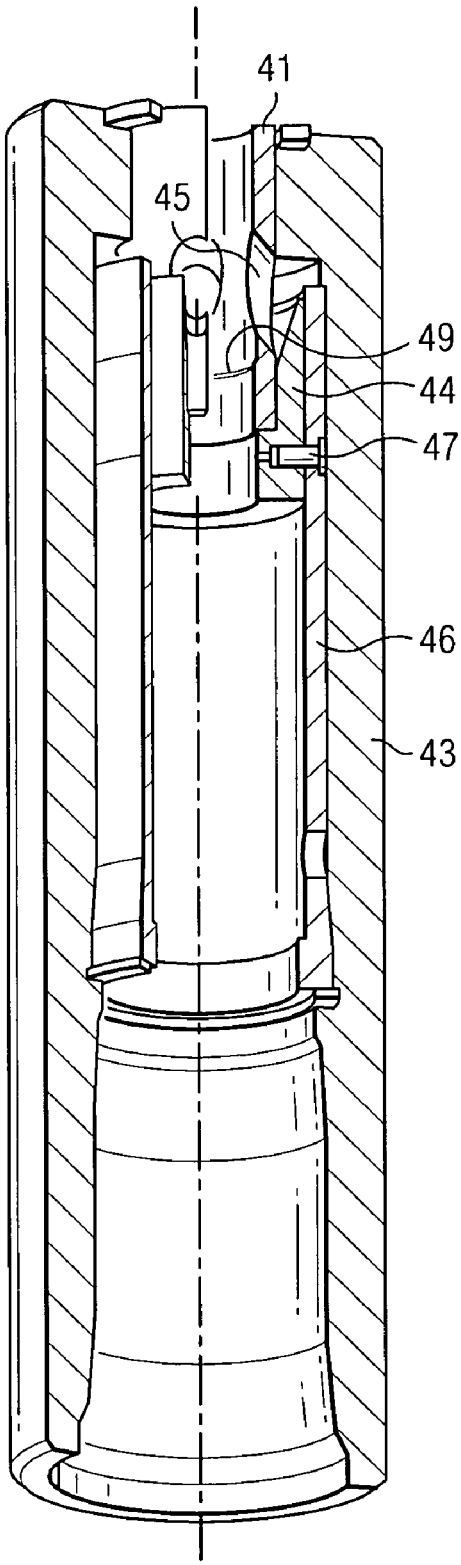
FIG. 12 is a perspective view, with portions broken away, of the underreaming and stabilizing tool of FIG. 1, illustrating an activation device in a deactivated position corresponding to the withdrawn position of the cutter elements.
Figure 13:
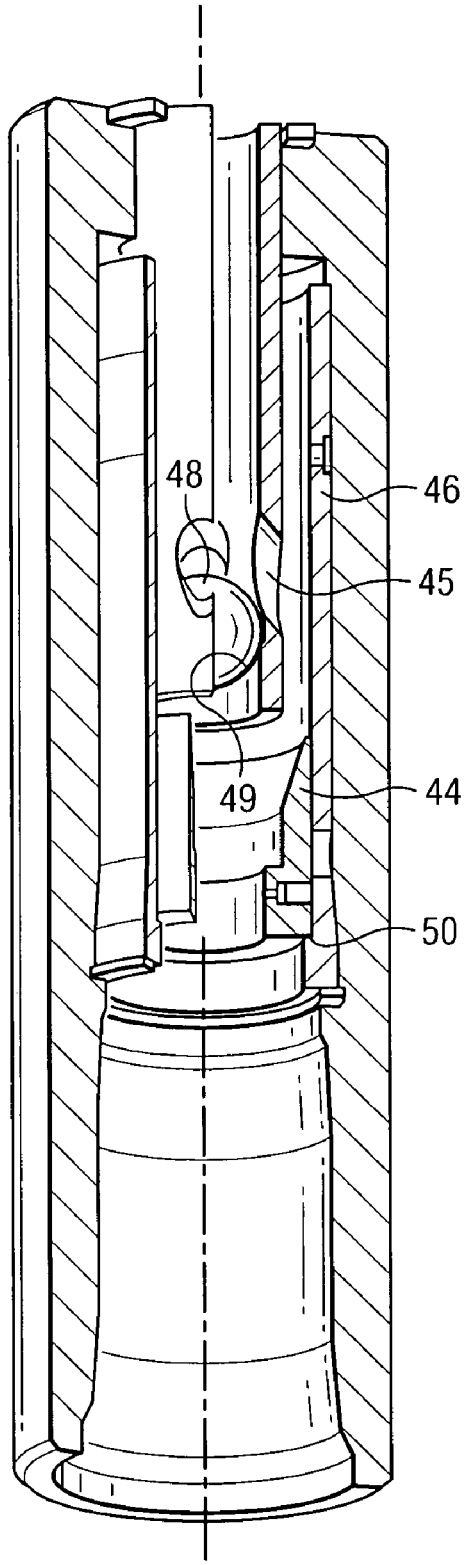
FIG. 13 is a perspective view, with portions broken away, of the underreaming and stabilizing tool of FIG. 1, illustrating the activation device of FIG. 12 in an activated position corresponding to the extended position of the cutter elements.
Figure 14:
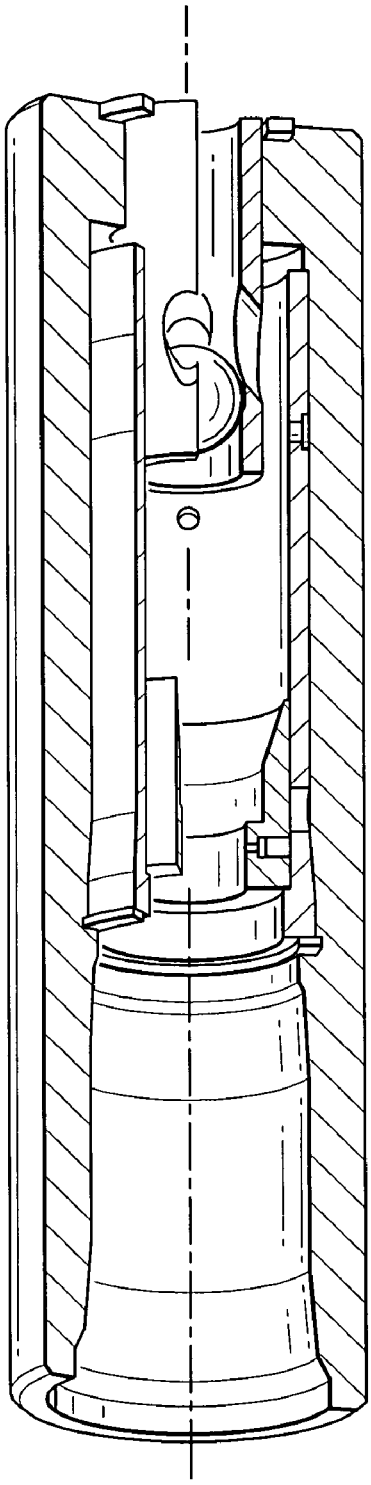
FIG. 14 is a perspective view, with portions broken away, of the underreaming and stabilizing tool of FIG. 1, illustrating the activation device of FIG. 12 in an activated position corresponding to the withdrawn position of the cutter elements.

According to another example implementation illustrated in FIGS. 12 to 14, the activation device comprises, at the end of extension pipe 41, a socket 44 surrounding the end of extension pipe 41. Socket 44 is provided with a number of lateral holes 45. Socket 44 is provided so as to be able to slide inside a sleeve 46 which is incorporated in a fixed manner in joining element 43. A shear pin 47 holds socket 44 in place over the end of extension pipe 41 in the initial position of drive pipe 11. In this manner socket 44 prevents any longitudinal movement of extension pipe 41 and therefore any longitudinal movement of drive pipe 11. The drilling mud passes through drive pipe 11, extension pipe 41, and sleeve 46 and then returns to the drilling string.

An activation ball 48 can be sent from the surface, coming to lodge against a terminal narrowing 49 of extension pipe 41. The application of activation ball 48 as depicted in FIG. 13 results, on the one hand, in a mechanical impact on shear pin 47 and, on the other hand, in a closing off of axial cavity 12 for passage of the drilling mud. This results in a huge increase in the pressure exerted on piston 13 of drive pipe 11. The increase in pressure results in the shearing of shear pin 47, as depicted in FIG. 13, and a sliding downwards of drive pipe 11. Through the pressure created inside terminal narrowing 49 situated upstream of socket 44, socket 44 is projected downwards as far as the position illustrated in FIG. 13 where it is halted by a limit stop 50. The sliding of drive pipe 11, and therefore of extension pipe 41, which is permitted by the chosen groove 30, is stopped before extension pipe 41 reaches socket 44 in its halted position. Consequently, circulation of the mud is then restored by flow through lateral holes 45. In this position, illustrated in FIG. 13, drive pipe 11 is released and can develop its longitudinal sliding motions. When the hydraulic pressure decreases, return spring 42 brings drive pipe 11 back to its initial position, as depicted for example in FIG. 14.

Figure 15:
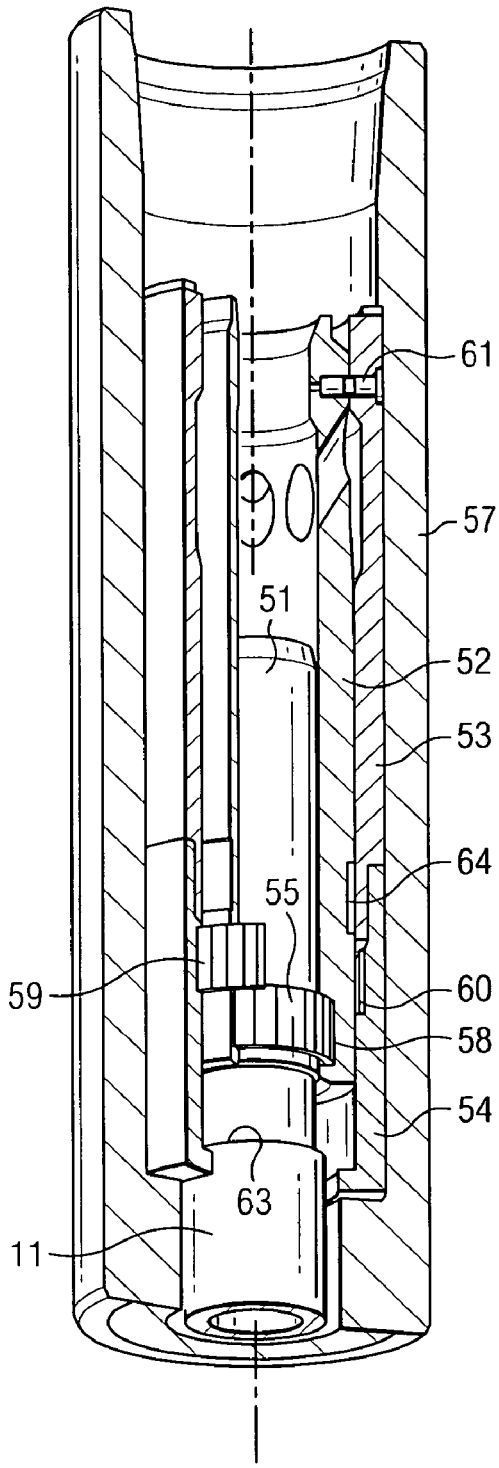
FIG. 15 is a perspective view, with portions broken away, of the underreaming and stabilizing tool of FIG. 1, illustrating a capture device in a deactivated position.
Figure 16:
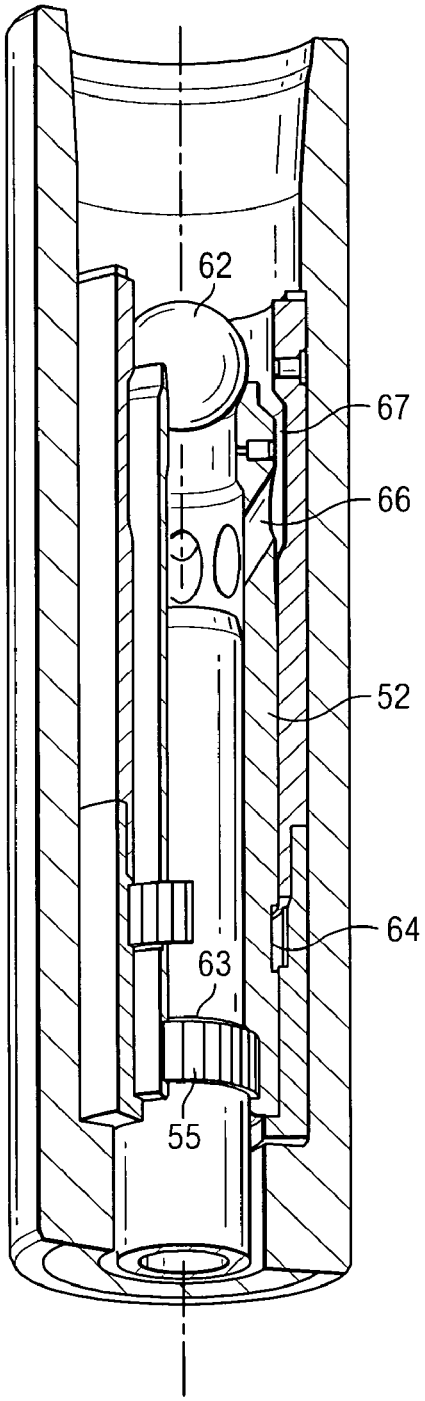
FIG. 16 is a perspective view, with portions broken away, of the underreaming and stabilizing tool of FIG. 1, illustrating the capture device of FIG. 15 in an activated position.

The tool according to the invention can also advantageously be provided with a drive pipe capture device. In the example implementation illustrated in FIGS. 15 and 16, drive pipe 11 is provided with a tubular lengthening piece 51 fixed thereon. Lengthening piece 51 is surrounded by a sleeve 52 capable of sliding over lengthening piece 51 and inside two successive sockets 53 and 54 that are connected to one another in a fixed manner. Sockets 53 and 54 are themselves embedded in a stationary manner inside a joining element 57 that is connected in a fixed manner to tubular body 1 in order to allow insertion of joining element 57 into a drilling string.

A first elastic catch ring 55 is housed in an internal slot 58 in sleeve 52 and can therefore slide with sleeve 52 over lengthening piece 51. A second elastic catch ring 59 is housed in an internal slot 60 formed between sockets 53 and 54 so as to be able to slide over sleeve 52.

In the initial position of drive pipe 11, and when the tool is being put into service, sleeve 52 is kept longitudinally inside fixed socket 53 by a shear pin 61. The drilling mud passes inside sleeve 52, lengthening piece 51, and drive pipe 11.

When the operation of the tool has to be stopped, for example in order to be raised to the surface, a second ball 62 with a diameter greater than that of sleeve 52 is sent into the drilling string. Ball 62 is stopped at the input of sleeve 52, closing off the passage. Through the mechanical impact of ball 62 and the great increase in fluid pressure, shear pin 61 is sheared off and the sleeve 52 can slide downwards.

During this downward sliding, a peripheral slot 64 in sleeve 52 takes up a position facing second elastic catch ring 59. Second elastic catch ring 59 lodges in peripheral slot 64, thus fixing together sleeve 52 and fixed sockets 53 and 54. Sleeve 52 is thereby also fixed to joining element 57 of tubular body 1. When the pressure is reduced, first elastic catch ring 55 lodges in a peripheral slot 63 provided in lengthening piece 51 of drive pipe 11. This occurs because drive pipe 11 is raised into its initial position by return spring 42, which fixes lengthening piece 51 and drive pipe 11 with the sleeve 52. In this position, drive pipe 11 is captured by tubular body 1 and cannot move anymore. As the upstream end of sleeve 52 is provided with lateral holes 66, the drilling mud can, in this capture position, continue to circulate by passing laterally around ball 62 in a space 67 formed between socket 53 and sleeve 52, through lateral holes 66, and through sleeve 52.

Figure 17:
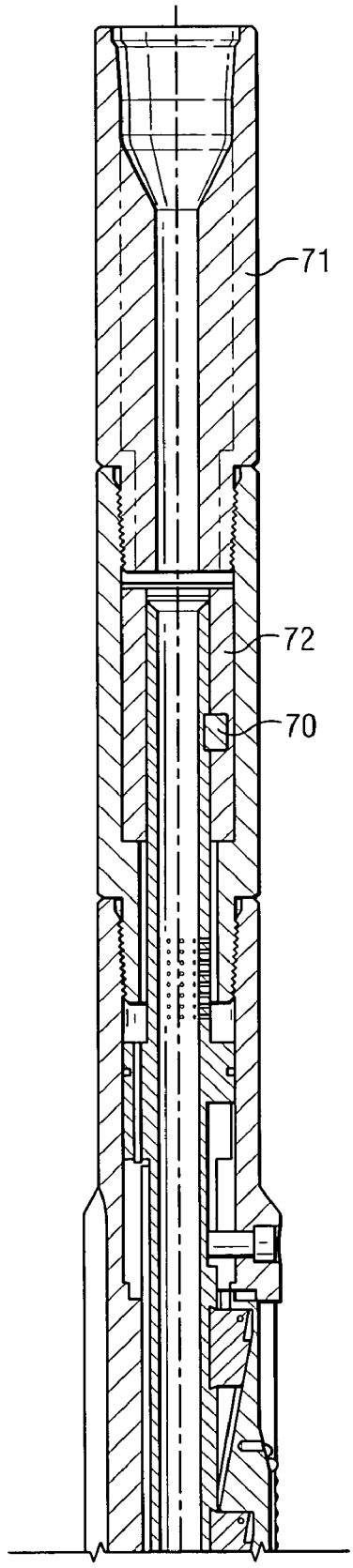
FIG. 17 is a longitudinal cross section view of an underreaming and stabilizing tool having an activation/capture device that is electrically actuated, in accordance with a particular embodiment of the present invention.

In an alternative embodiment, a latch element may longitudinally keep drive pipe 11 in its initial position in tubular body 1. An electrical control similar to those already known in the art may be used to actuate the latch element. The electrical control may be situated on the surface or integral to the drilling string and may be electrically coupled to the latch. The electrical control may be operable to actuate the latch between open and closed positions and thereby release and capture drive pipe 11. FIG. 17 illustrates an embodiment utilizing a latch which is controlled by an electronic device 71. Electronic device 71 may be activated by pulsations of fluid. When electrical device 71 is activated, it signals latch activator 72 to open or close latch 70 and thereby allow or restrict movement of the drive pipe.

Figure 18:
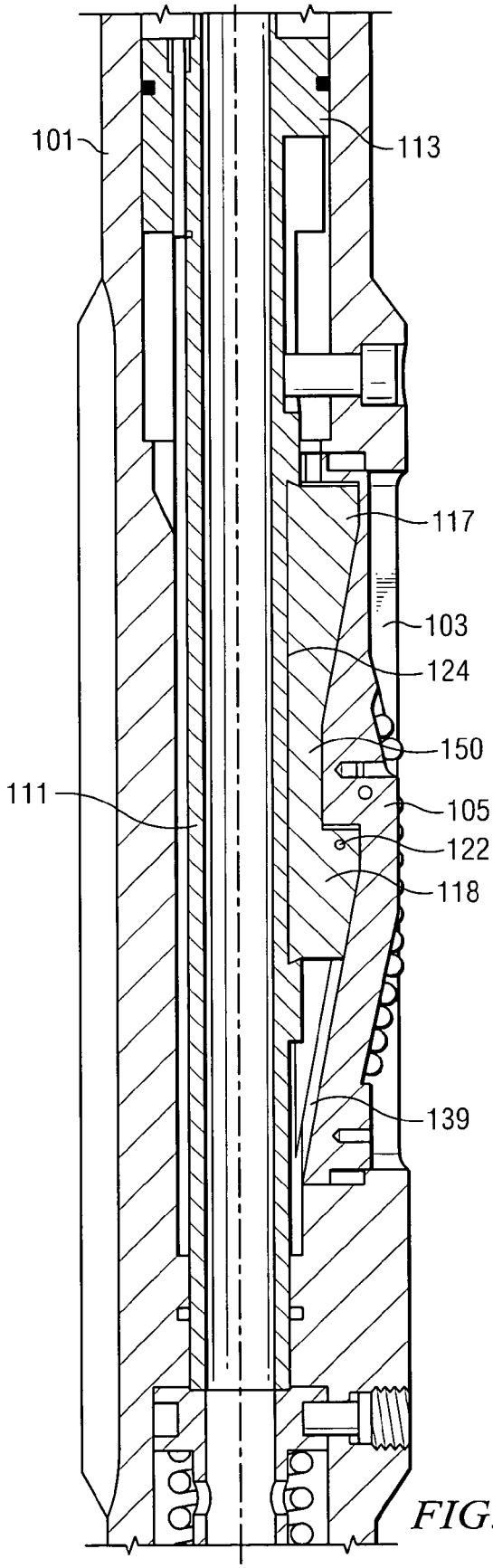
FIG. 18 is a longitudinal cross section view of an underreaming and stabilizing tool having two rigidly coupled wedge elements per cutter element, in accordance with the teachings of the present invention.
Figure 19:
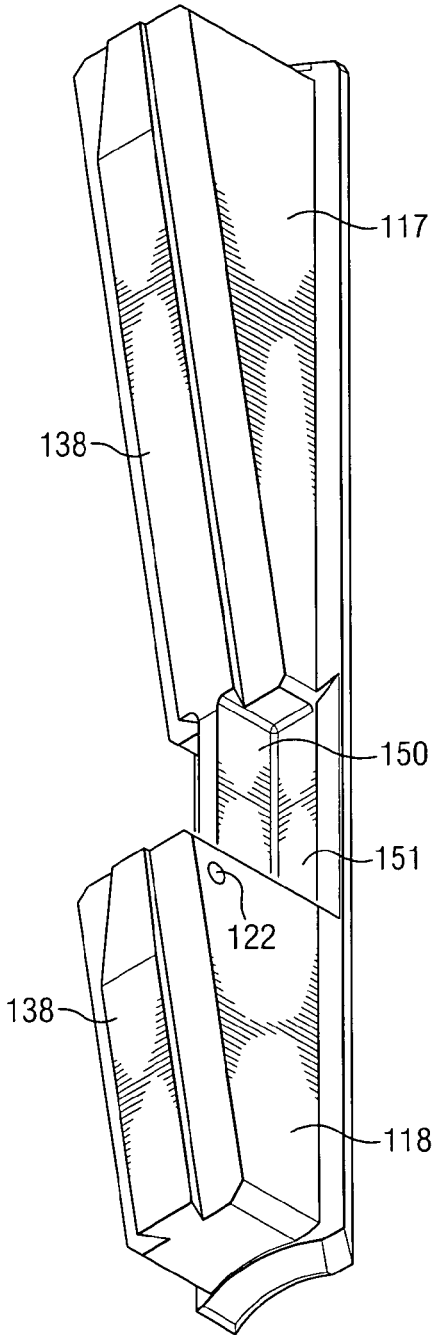
FIG. 19 is a perspective view of the rigidly coupled wedge elements of the underreaming and stabilizing tool of FIG. 18, in accordance with the teachings of the present invention.

FIGS. 18 and 19 illustrate an embodiment of an underreaming and stabilizing tool with two wedge elements 117 and 118 that are rigidly coupled to each other. Similar to the embodiments described above, a cutter element 105 is disposed within a radial guidance channel 103. When a fluid pressure acts on piston 113, drive pipe 111 moves longitudinally downward. Wedge elements 117 and 118 are coupled to drive pipe 111 and move longitudinally with drive pipe 111. The downward longitudinal movement of the wedge elements 117 and 118 causes a corresponding radial extension of cutter element 105 within radial guidance channel 103.

Distinct from the above described embodiments, the wedge elements 117 and 118 may be rigidly connected to each other. In the illustrated embodiment, wedge elements 117 and 118 are coupled together by a rectangular cross member 150 and have a common base 151. Wedge elements 117 and 118 may be formed as a single piece with cross member 150 and base 151 by casting or billeting the entire assembly, or the pieces may be coupled together after being formed by welding or other appropriate fixing method. Further, the shape of cross member 150 is not limited to a rectangular shape and may be practically any shape. Likewise, the number of wedge elements is not limited to two, but may be practically any desired number.

As drive pipe 111 is installed into tubular body 101, base 151 of wedge elements 117 and 118 may slide along a longitudinal slot as described above. Drive pipe 111 may then be rotated into its second angular position, or installed position, and base 151 may slide into peripheral slot 124. Base 151 and peripheral slot 124 may form a dove-tail joint as described above. This arrangement allows for installation of the assembled wedge elements 117 and 118 with cutter elements 105 prior to installation of drive pipe 111, while providing a secure coupling of wedge elements 117 and 118 to drive pipe 111 when drive pipe 111 is in its second angular position.

Also similar to the embodiments described above, wedge elements 117 and 118 may be coupled with cutter element 105 by dove-tail slot 139 and molding 138. This assembly may be held together in an initial, unactivated position by shear pin 122. An advantage of rigidly coupling wedge elements 117 and 118 is that only one shear pin 122 is needed to couple wedge elements 117 and 118 to cutter assembly 105. Shear pin 122 is designed to be destroyed during activation and using only one shear pin 122 reduces waste and assembly time.

The embodiment illustrated in FIGS. 18 and 19 also provides wedge elements 117 and 118 having a resistance to titling or rotating within peripheral slot 124. If wedge elements 117 and 118 tilt or rotate within peripheral slot 124, jamming of the tool may occur. If the tool jams, it may not be able to fulfill the underreaming and/or stabilizing functions, may become damaged, and may require removal of the entire string or abandonment of the drilled hole. Therefore, providing rigidly coupled wedge elements 117 and 118 reduces the chances of jamming and thereby increases reliability of the tool.

Numerous other changes, substitutions, variations, alterations and modifications may be ascertained by those skilled in the art and it is intended that the present invention encompass all such changes, substitutions, variations, alterations and modifications as falling within the spirit and scope of the appended claims. Moreover, the present invention is not intended to be limited in any way by any statement in the specification that is not otherwise reflected in the claims.

What is claimed is:

1. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow removal of the drive pipe from within the axial cavity independently of the wedge element; and wherein:

the drive pipe is coupled to the wedge element and configured to move the wedge element from the first position to the second position as the drive pipe moves from a first longitudinal position to a second longitudinal position;

the drive pipe defines a longitudinal slot along an intermediate portion of the drive pipe and a peripheral slot disposed adjacent a first end of the longitudinal slot;

the drive pipe is configured to permit the wedge element to slide within the longitudinal slot when the drive pipe is in a first angular position; and the drive pipe is configured to fixedly couple the wedge element to the peripheral slot of the drive pipe as the drive pipe is rotated from the first angular position to a second angular position.

2. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow rotation of the drive pipe within the axial cavity; and wherein:

the drive pipe is coupled to the wedge element and configured to move the wedge element from the first position to the second position as the drive pipe moves from a first longitudinal position to a second longitudinal position;

the drive pipe defines a longitudinal slot along an intermediate portion of the drive pipe and a peripheral slot disposed adjacent a first end of the longitudinal slot;

the drive pipe is configured to permit the wedge element to slide within the longitudinal slot when the drive pipe is in a first angular position; and the drive pipe is configured to fixedly couple the wedge element to the peripheral slot of the drive pipe as the drive pipe is rotated from the first angular position to a second angular position.

3. The drilling tool of claim 2:

wherein the drive pipe defines at least a first longitudinal groove having a length corresponding to a distance between the first and second longitudinal positions of the drive pipe;

wherein the tubular body further defines at least a first aperture aligning with the first longitudinal groove when the drive pipe is in the second angular position; and further comprising a generally cylindrical immobilizing element passing through the first aperture and protruding into the first longitudinal groove.

4. The drilling tool of claim 3, wherein the length of the first longitudinal groove determines a length of radial displacement of the cutter element.

5. The drilling tool of claim 3, wherein the drive pipe defines a second longitudinal groove having a length different than the length of the first longitudinal groove.

6. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow removal of the drive pipe from within the axial cavity independently of the wedge element; and wherein:

the tubular body has at its periphery a first raised ridge at a first end of the at least one radial guidance channel and a second raised ridge at a second end of the at least one radial guidance channel;

the first raised ridge is configured to abut a first surface of the cutter element when the cutter element is in the extended position and the second raised ridge is configured to abut a second surface of the cutter element when the cutter element is in the extended position; and the abutting of the first raised ridge with the first surface and the abutting of the second raised ridge with the second surface defines a maximum radial extension of the cutter element.

7. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow rotation of the drive pipe within the axial cavity; and wherein:

the drive pipe is coupled to the wedge element and configured to move the wedge element from the first position to the second position as the drive pipe moves from a first longitudinal position to a second longitudinal position;

the drive pipe includes a piston separating a first section of the axial cavity from a second section of the axial cavity, wherein the piston defines a small diameter duct passing from the first section of the axial cavity to the second section of the axial cavity;

the first section having an internal pressure;

the second section having an external pressure approximately the same as a well bore pressure;

wherein the external pressure is less than the internal pressure to facilitate movement of the drive pipe; and wherein the drive pipe defines a plurality of perforations in a section of the drive pipe separating a hollow annulus of the drive pipe from the small diameter duct.

8. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow removal of the drive pipe from within the axial cavity independently of the wedge element, and wherein the drive pipe is coupled to the wedge element and configured to move the wedge element from the first position to the second position as the drive pipe moves from a first longitudinal position to a second longitudinal position;

an extension tube fixedly coupled at a first end to an end of the drive pipe;

the tubular body further defining an aperture; and a shear pin passing through the aperture and releasably coupling the extension tube to the tubular body.

9. The drilling tool of claim 8, further comprising:

a tubular joining element coupled to one end of the tubular body;

wherein a second end of the extension pipe extends into a hollow cavity of the joining element;

a socket surrounding a second end of the extension pipe;

a tubular sleeve fixedly coupled to the interior of the hollow cavity of the joining element and surrounding the socket; and wherein the socket is releasably coupled to tubular sleeve by at least a second shear pin.

10. A drilling tool, comprising:

a tubular body defining a longitudinal axial cavity extending therethrough;

the tubular body also defining at least one radial guidance channel extending radially from the axial cavity through the tubular body;

a cutter element disposed in the at least one radial guidance channel;

the cutter element including an internal surface inclined at an angle to a longitudinal axis of the tubular body;

a wedge element having an external surface configured to engage the internal surface of the cutter element and to direct the cutter element from a retracted position to an extended position as the wedge element moves from a first position to a second position;

a drive pipe disposed within the axial cavity, the drive pipe being configured to be removably coupled with the wedge element and to allow removal of the drive pipe from within the axial cavity independently of the wedge element, and wherein the drive pipe is coupled to the wedge element and configured to move the wedge element from the first position to the second position as the drive pipe moves from a first longitudinal position to a second longitudinal position;

a tubular lengthening piece fixedly coupled to one end of the drive pipe;

a sleeve surrounding the tubular lengthening piece;

at least a first socket surrounding the sleeve and fixedly coupled to the tubular body;

the sleeve having an unactivated position where it is releasably coupled to the first socket and an activated position where it is fixedly coupled to the tubular lengthening piece such that the drive tube is held in the first longitudinal position.

11. A drilling tool, comprising:

a tubular body defining a longitudinal axial cavity extending therethrough;

the tubular body also defining first, second, and third radial guidance channels extending radially from the axial cavity through the tubular body;

a first cutter element disposed in the first radial guidance channel;

a second cutter element disposed in the second radial guidance channel;

a third cutter element disposed in the third radial guidance channel;

the first cutter element including first and second internal surfaces inclined at a first angle to a longitudinal axis of the tubular body;

the second cutter element including third and fourth internal surfaces inclined at a second angle to the longitudinal axis of the tubular body;

the third cutter element including fifth and sixth internal surfaces inclined at a third angle to the longitudinal axis of the tubular body;

a first wedge element having first and second external surfaces configured to engage the first and second internal surfaces of the first cutter element and to direct the first cutter element from a retracted position to an extended position as the first wedge element moves from a first position to a second position;

a second wedge element having third and fourth external surfaces configured to engage the third and fourth internal surfaces of the second cutter element and to direct the second cutter element from a retracted position to an extended position as the second wedge element moves from a first position to a second position;

a third wedge element having fifth and sixth external surfaces configured to engage the fifth and sixth internal surfaces of the third cutter element and to direct the third cutter element from a retracted position to an extended position as the third wedge element moves from a first position to a second position;

a drive pipe disposed within the longitudinal axial cavity and coupled to the first, second, and third wedge elements;

the drive pipe configured to move the first, second, and third wedge elements from the respective first positions to the respective second positions as the drive pipe moves from a first longitudinal position to a second longitudinal position;

the drive pipe defining first, second, and third longitudinal slots along an intermediate portion of the drive pipe;

the drive pipe also defining a first peripheral slot disposed adjacent the first longitudinal slot;

the drive pipe also defining a second peripheral slot disposed adjacent the second longitudinal slot;

the drive pipe also defining a third peripheral slot disposed adjacent the third longitudinal slot;

wherein the drive pipe is configured to permit the first wedge element to slide within the first longitudinal slot when the drive pipe is in a first angular position;

wherein the drive pipe is configured to permit the second wedge element to slide within the second longitudinal slot when the drive pipe is in the first angular position;

wherein the drive pipe is configured to permit the third wedge element to slide within the third longitudinal slot when the drive pipe is in the first angular position;

wherein the drive pipe is configured to fixedly couple the first wedge element to the first peripheral slot of the drive pipe as the drive pipe is rotated from the first angular position to a second angular position;

wherein the drive pipe is configured to fixedly couple the second wedge element to the second peripheral slot of the drive pipe as the drive pipe is rotated from the first angular position to the second angular position;

wherein the drive pipe is configured to fixedly couple the third wedge element to the third peripheral slot of the drive pipe as the drive pipe is rotated from the first angular position to the second angular position;

the drive pipe including a plurality of longitudinal grooves;

the tubular body including a plurality of apertures;

wherein each of the plurality of apertures align with one of the plurality of longitudinal grooves when the drive pipe is in the second angular position;

wherein the drive pipe is radially held in the second angular position while still capable of longitudinal movement by an immobilizing element disposed in one of the plurality of apertures such that an end of the immobilizing element resides in the longitudinal groove corresponding to the one of the plurality of apertures;

wherein at least one of the plurality of longitudinal grooves has a different length than at least one of the other of the plurality of longitudinal grooves; and wherein the maximum radial displacements of the first, second, and third cutter elements are selected by passing the immobilizing element through the one of the plurality of apertures corresponding to the one of the plurality of longitudinal grooves that corresponds to a length of longitudinal displacement of the drive pipe that provides desired maximum radial displacements of the first, second, and third cutter elements.

12. A method, comprising:

installing a cutter element and a wedge element at least partially within a radial guidance channel of a tubular body by passing the cutter element through a longitudinal axial cavity of the tubular body;

moving the cutter element and the wedge element radially outward from the longitudinal axial cavity at least partially into the radial guidance channel;

moving the cutter element from a retracted position to an extended position by moving the wedge element from a first longitudinal position to a second longitudinal position;

installing a drive pipe in the axial cavity;

coupling the drive pipe to the first wedge element;

moving the wedge element from the first longitudinal position to the second longitudinal position by moving the drive pipe from an inactive position to an active position; and wherein the installing the drive pipe in the axial cavity includes:

orienting the drive pipe in a first angular position;

inserting an end of the drive pipe into an end of the tubular body;

sliding the drive pipe into the axial cavity; and rotating the drive pipe to a second angular position.

13. The method of claim 12, further comprising:

aligning a plurality of apertures in the tubular body with respective ones of a plurality of longitudinal grooves in the drive pipe by orienting the drive pipe in the second angular position;

holding the drive pipe in the second angular position while allowing longitudinal movement of the drive pipe by passing an immobilizing element through one of the plurality of apertures such that an end of the immobilizing element resides in the respective one of the plurality of longitudinal grooves corresponding to the one of the plurality of apertures.

14. The method of claim 13, further comprising:

each of the plurality of longitudinal grooves having a different length than each of the other of the plurality of longitudinal grooves; and selecting the maximum longitudinal displacement of the drive pipe by passing the immobilizing element through the one of the plurality of apertures corresponding to the one of the plurality of longitudinal grooves that corresponds to a desired maximum longitudinal displacement of the drive pipe.

15. The method of claim 13, further comprising:

wherein at least one of the plurality of longitudinal grooves has a different length than at least one of the other of the plurality of longitudinal grooves; and selecting the maximum radial displacement of the cutter element by passing the immobilizing element through the one of the plurality of apertures corresponding to the one of the plurality of longitudinal grooves that corresponds to a desired maximum radial displacement of the cutter element.

16. The method of claim 12, further comprising coupling the wedge element to the drive pipe by:

sliding a portion of the wedge element extending into the axial cavity along a longitudinal slot of the drive pipe as the drive pipe is being slid into the axial cavity; and sliding the portion of the wedge element extending into the axial cavity into a peripheral slot of the drive pipe as the drive pipe is rotated to the second angular position.

17. A method, comprising:

installing a cutter element and a wedge element at least partially within a radial guidance channel of a tubular body by passing the cutter element through a longitudinal axial cavity of the tubular body;

moving the cutter element and the wedge element radially outward from the longitudinal axial cavity at least partially into the radial guidance channel;

moving the cutter element from a retracted position to an extended position by moving the wedge element from a first longitudinal position to a second longitudinal position;

installing a drive pipe in the axial cavity;

coupling the drive pipe to the first wedge element;

moving the wedge element from the first longitudinal position to the second longitudinal position by moving the drive pipe from an inactive position to an active position;

coupling a capture device to the drive pipe; and the capture device being operable to hold the drive pipe in a final longitudinal position until the capture device is reset.

18. A method, comprising:

increasing a fluid pressure of a drilling fluid circulating inside an axial cavity of a tubular body;

increasing a surface pressure on a piston of a drive pipe disposed within the axial cavity of the tubular body by increasing the fluid pressure of the drilling fluid;

directing a longitudinal movement of the drive pipe and a wedge element removably coupled to the drive pipe by increasing the surface pressure on the piston, wherein the drive pipe is configured to allow removal of the drive pipe from within the axial cavity independently of the wedge element;

directing a radial movement of a cutter element disposed in a radial guidance channel of the tubular body by directing the longitudinal movement of the drive pipe and a wedge element; and installing the drive pipe in the axial cavity of the tubular body including:

orienting the drive pipe in a first angular position;

inserting an end of the drive pipe into an end of the tubular body;

sliding the drive pipe into the axial cavity; and rotating the drive pipe to a second angular position.

19. The method of claim 18, further comprising:

aligning a plurality of apertures in the tubular body with respective ones of a plurality of longitudinal grooves in the drive pipe by orienting the drive pipe in the second angular position;

holding the drive pipe in the second angular position while allowing longitudinal movement of the drive pipe by passing an immobilizing element through one of the plurality of apertures such that an end of the immobilizing element resides in the respective one of the plurality of longitudinal grooves corresponding to the one of the plurality of apertures.

* * * * *